US008763275B2

(12) United States Patent
Shalom et al.

(10) Patent No.: US 8,763,275 B2
(45) Date of Patent: Jul. 1, 2014

(54) FOLDABLE FOOTWEAR

(76) Inventors: Mor Talia Shalom, Rehovot (IL); Sivan Gal Shalom, Rehovot (IL)

( * ) Notice: Subject to any disclaimer, the term of this patent is extended or adjusted under 35 U.S.C. 154(b) by 213 days.

(21) Appl. No.: 13/098,533

(22) Filed: May 2, 2011

(65) Prior Publication Data

US 2012/0079745 A1 Apr. 5, 2012

(30) Foreign Application Priority Data

May 2, 2010 (IL) ..... 205479

(51) Int. Cl.
*A43B 3/12* (2006.01)

(52) U.S. Cl.
USPC ..... 36/11.5; 36/7.5; 36/102

(58) Field of Classification Search
USPC ..... 36/102, 11.5, 7.5
See application file for complete search history.

(56) References Cited

U.S. PATENT DOCUMENTS

| | | | | | |
|---|---|---|---|---|---|
| 1,250,852 | A | * | 12/1917 | Goldstone | 36/11.5 |
| D136,513 | S | | 1/1943 | Meltzer | |
| 2,590,648 | A | * | 3/1952 | Pitz | 36/11.5 |
| 3,121,962 | A | | 2/1964 | Gullo | |
| 4,059,910 | A | * | 11/1977 | Bryden et al. | 36/103 |
| 4,241,524 | A | * | 12/1980 | Sink | 36/102 |
| 4,779,361 | A | * | 10/1988 | Kinsaul | 36/102 |
| 4,967,491 | A | | 11/1990 | Plotkin | |
| 5,481,814 | A | | 1/1996 | Spencer | |
| 5,926,975 | A | * | 7/1999 | Goodman et al. | 36/31 |
| 6,189,239 | B1 | | 2/2001 | Dalton et al. | |
| 7,032,327 | B1 | * | 4/2006 | Tartaglia et al. | 36/11.5 |
| 7,376,999 | B2 | * | 5/2008 | Haft | 12/142 S |
| 7,448,148 | B2 | * | 11/2008 | Martinez et al. | 36/11.5 |
| D610,785 | S | * | 3/2010 | Smith | D2/947 |
| 7,694,435 | B1 | * | 4/2010 | Kiser et al. | 36/11.5 |
| D615,736 | S | * | 5/2010 | Kiser | D2/917 |
| 7,735,244 | B1 | | 6/2010 | Ameche | |
| 8,245,420 | B2 | * | 8/2012 | Wilson | 36/102 |
| 2003/0033730 | A1 | * | 2/2003 | Burke et al. | 36/25 R |
| 2006/0096124 | A1 | | 5/2006 | Moseley | |
| 2006/0156576 | A1 | | 7/2006 | Sloan | |
| 2006/0156578 | A1 | * | 7/2006 | Haft | 36/9 R |
| 2006/0174513 | A1 | | 8/2006 | Martinez | |
| 2006/0185195 | A1 | | 8/2006 | Weisner et al. | |
| 2007/0204483 | A1 | * | 9/2007 | Kirsch et al. | 36/11.5 |
| 2007/0220777 | A1 | * | 9/2007 | Richardson | 36/11.5 |
| 2008/0040949 | A1 | * | 2/2008 | Moseley | 36/103 |
| 2008/0052964 | A1 | | 3/2008 | Taylor | |
| 2008/0168683 | A1 | * | 7/2008 | Keating | 36/102 |
| 2009/0193685 | A1 | * | 8/2009 | Wilson | 36/102 |
| 2010/0018080 | A1 | | 1/2010 | Smith | |

(Continued)

FOREIGN PATENT DOCUMENTS

| | | |
|---|---|---|
| AU | 2001002751 | 2/2001 |
| AU | 2008332889 A1 | 6/2009 |

(Continued)

*Primary Examiner* — Katherine Moran
*Assistant Examiner* — Megan Brandon
(74) *Attorney, Agent, or Firm* — Leber Patent Law PC

(57) ABSTRACT

A foldable footwear comprising a sole fabricated using a single manufacturing casting, the sole comprising at least two portions, a front portion and a back portion and a groove in the ground side of the sole extending laterally from one side of the sole to the other side of the sole. The footwear can be folded in one direction only where the ground side of the sole is folded into itself.

17 Claims, 8 Drawing Sheets

(56) References Cited

U.S. PATENT DOCUMENTS

| | | | | |
|---|---|---|---|---|
| 2010/0095554 | A1 | 4/2010 | Gillespie | |
| 2010/0115793 | A1 | 5/2010 | Kraisosky | |
| 2010/0281713 | A1* | 11/2010 | Pantazes | 36/102 |
| 2011/0016748 | A1* | 1/2011 | Soler | 36/102 |
| 2011/0094125 | A1* | 4/2011 | Weightman | 36/102 |
| 2011/0214312 | A1* | 9/2011 | Krikelis | 36/102 |

FOREIGN PATENT DOCUMENTS

| | | | | |
|---|---|---|---|---|
| AU | 2009250965 | A1 | | 1/2010 |
| AU | 2009101166 | A4 | | 2/2010 |
| AU | 2010100071 | A4 | | 2/2010 |
| BR | MU8600853 | | | 1/2008 |
| CN | 86204511 | | | 2/1987 |
| CN | 86204511 | U | * | 2/1987 |
| CN | 1620957 | | | 6/2005 |
| CN | 200944874 | Y | | 9/2007 |
| CN | 201139113 | Y | | 10/2008 |
| CN | 201216215 | Y | | 4/2009 |
| CN | 201518782 | | | 7/2010 |
| DE | 1914002 | | | 4/1965 |
| DE | 8710275 | | | 9/1987 |
| DE | 4244293 | | | 7/1993 |
| ES | 1003964 | | | 8/1988 |
| ES | 1054838 | | | 9/2003 |
| ES | 1071597 | U | | 3/2010 |
| GB | 191228488 | A | | 0/1913 |
| GB | 200508725 | | | 11/2006 |
| GB | 2432295 | A1 | | 5/2007 |
| GB | 200722202 | | | 5/2008 |
| GB | 200709690 | A | | 12/2008 |
| JP | 9019301 | | | 1/1997 |
| JP | 9019301 | A | * | 1/1997 |
| JP | 2007082992 | | | 4/2007 |
| JP | 2008212612 | | | 9/2008 |
| KR | 20090121830 | | | 11/2009 |
| RU | 2286702 | C | | 11/2006 |
| WO | 2010060158 | A1 | | 6/2010 |

* cited by examiner

FOLDABLE FOOTWEAR

CROSS REFERENCE TO OTHER APPLICATIONS

The present invention claims priority according the Paris Convention from Israeli Patent Application 205479 filed on May 2, 2010, which is incorporated herein by reference.

FIELD OF THE INVENTION

The present invention relates to the field of footwear in general. More particularly, the invention relates to foldable shoes.

BACKGROUND OF THE INVENTION

A footwear, such as a shoe includes a sole and an upper part that hold the footwear onto the foot. The sole includes a ground-side, which is the layer in contact with the ground when the footwear is worn, and a foot-side, which is the layer in contact with the foot of the user when the footwear is worn.

A foldable footwear is a footwear which, upon not wearing allows folding thereof for carrying or packaging purposes.

Many women wear high-heel shoes on many occasions in order to be fashionable, however many of these shoes are not comfortable to wear for many hours and as a result, women may wish to change to more comfortable shoes, for example, when going back home.

There is thus a need to provide foldable shoes that can be carried in a compact package, for example, fitting in a woman's purse or bag so that a woman can easily change to more comfortable shoes when she is no longer obligated to wear uncomfortable shoes.

SUMMARY OF THE INVENTION

It is an object of the present invention to provide foldable footwear.

It is another object of the present invention to provide footwear that is foldable with the one part of the sole touching the other part of the sole so that when touching the folded footwear one does not have to touch the footwear's sole.

It is a further object of the present invention to provide footwear that is foldable in one direction only with the one part of the sole touching the other part of the sole.

It is yet another object of the present invention to provide foldable footwear with straps, wherein the straps help keep the footwear unfolded when the footwear is worn.

The present invention thus relates to a foldable footwear comprising:

a. a sole fabricated using a single manufacturing casting, said sole having a ground side which touches the ground when the footwear is worn and a foot side which touches the user's foot when the footwear is worn, said sole comprising at least two portions, a front portion and a back portion; and b. at least one groove in the ground side of the sole, separating the front portion from the back portion and extending laterally from one side of the sole to the other side of the sole, said groove having a front portion edge and a back portion edge;

wherein said footwear can be folded in one direction only where the ground side of the front portion is folded towards the ground side of the back portion such that the groove's front portion edge touches the groove's back portion edge.

In some embodiments, the groove is substantially cylindrical.

In some embodiments, the at least one groove's maximal height is 0.2 to 0.9 the thickness of the sole.

In some embodiments, the at least one groove is positioned substantially in the middle of the sole.

In some embodiments, the foldable footwear further comprises a strap attached on one side to the front portion and on the other side attached to the back portion, wherein the strap is stretched when the footwear is worn thus helping to keep the sole unfolded.

In some embodiments, the foldable footwear further comprises a plurality of notches on the foot side of the sole, substantially positioned above said at least one groove, said notches forming a plurality of adjacent bands, wherein the each band's width on the foot side (A2) is larger than the width of the bottom of its adjacent notches (A1) such that said bands are drawn away from each other upon folding said footwear in the direction where the ground side of the front portion is moved towards the ground side of the back portion, and said bands are drawn closer to each other when the footwear is unfolded, said bands effectively preventing the footwear from being folded in the direction where the foot side of the front portion is folded towards the foot side of the back portion since the bands will eventually touch each other.

In some embodiments, the footwear is a flip-flop sandal.

In some embodiments, the sole of said flip-flop sandal is made from a flexible material comprising rubber or polyurethane.

BRIEF DESCRIPTION OF THE DRAWINGS

Embodiments and features of the present invention are described herein in conjunction with the following drawings.

It should be understood that the drawings are not necessarily drawn to scale.

DETAILED DESCRIPTION OF PREFERRED EMBODIMENTS

The present invention will be understood from the following detailed description of preferred embodiments, which are meant to be descriptive and not limiting. For the sake of brevity, some well-known features, methods, systems, procedures, components, circuits, and so on, are not described in detail.

Figure 1:
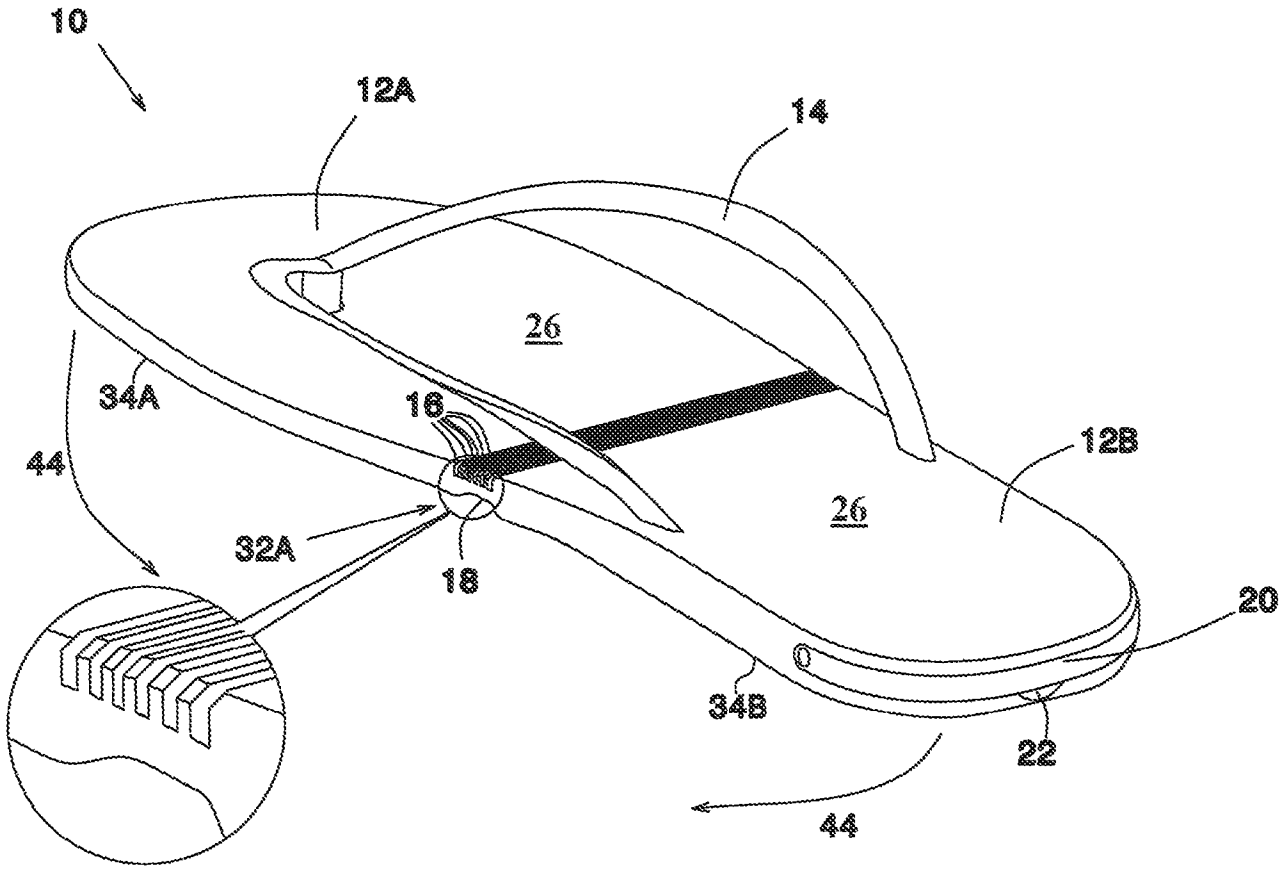
FIG. 1 depicts a foldable footwear at the deployed state, according to one embodiment of the present invention.

FIG. 1 depicts a foldable footwear 10 at the deployed state, according to one embodiment of the present invention.

The foldable footwear's 10 sole 26 comprises at least two portions, a relatively rigid front portion 12A, a relatively rigid back portion 12B. At least one relatively foldable structure 32A comprising a groove 18 in the ground side of the sole 26 separates the front portion 12A from the back portion 12B and extends laterally from one side of the sole 26 to the other side of the sole 26.

According to a preferred embodiment, the sole-portions 12A and 12B and also the foldable structure 32A are all produced together as a single casting of a flexible material, such as hard rubber, polyurethane, or other similar materials.

The term "foot-side" as used herein refers to the side of the sole 26 which is in contact with the foot of the user when a footwear 10 is worn.

The term "ground-side" as used herein refers to the side of the sole 26 which is in contact with the ground when a footwear 10 is worn.

Footwear 10 is foldable in one direction only, which is the direction depicted by arrows 44. Namely, foldable footwear 10 is folded so that the ground side 34A of the front portion 12A is folded towards the ground side 34B of the back portion 12B. When the footwear 10 is folded over the groove 18, the front portion edge of the groove 18 touches the back portion edge of the groove 18.

In this way, since a footwear's 10 sole is usually dirty from contact with the ground, when a user holds the folded footwear 10 of the invention, the user is holding the foot-side and not the ground-side, hence the user's hands will not get dirty.

The weight of the user's foot on the groove 32A prevents folding the footwear 10 in the direction of arrows 44 while being worn.

Stretchable straps 14 may attach footwear 10 to the foot of the user, and are stretched upon folding footwear 10. When the user wears the footwear 10, the stretchable straps 14 help in keeping the footwear 10 unfolded.

Optionally, a stretchable strap 20 can be pivotally connected to sole-portions 12A or 12B, in order to retain the footwear 10 in a folded state. Strap 20 may be rotated by inserting a finger into a depression 22. A person skilled in the art will easily be able to use many available alternatives in order to incorporate alternative solutions in order to maintain the footwear 10 in a folded state.

In some embodiments, the foldable footwear 10 further comprises a plurality of notches on the foot-side of the sole 26, substantially positioned above the groove 18, the notches forming a plurality of adjacent bands 16. The bands 16 are drawn away from each other upon folding the footwear 10 in the direction of arrow 44, and the bands 16 are drawn closer to each other when the footwear 10 is unfolded. Thus the bands 16 help to prevent the footwear 10 from being folded in the direction contrary to arrow 44 since the bands 16 will eventually touch each other.

Figure 2:
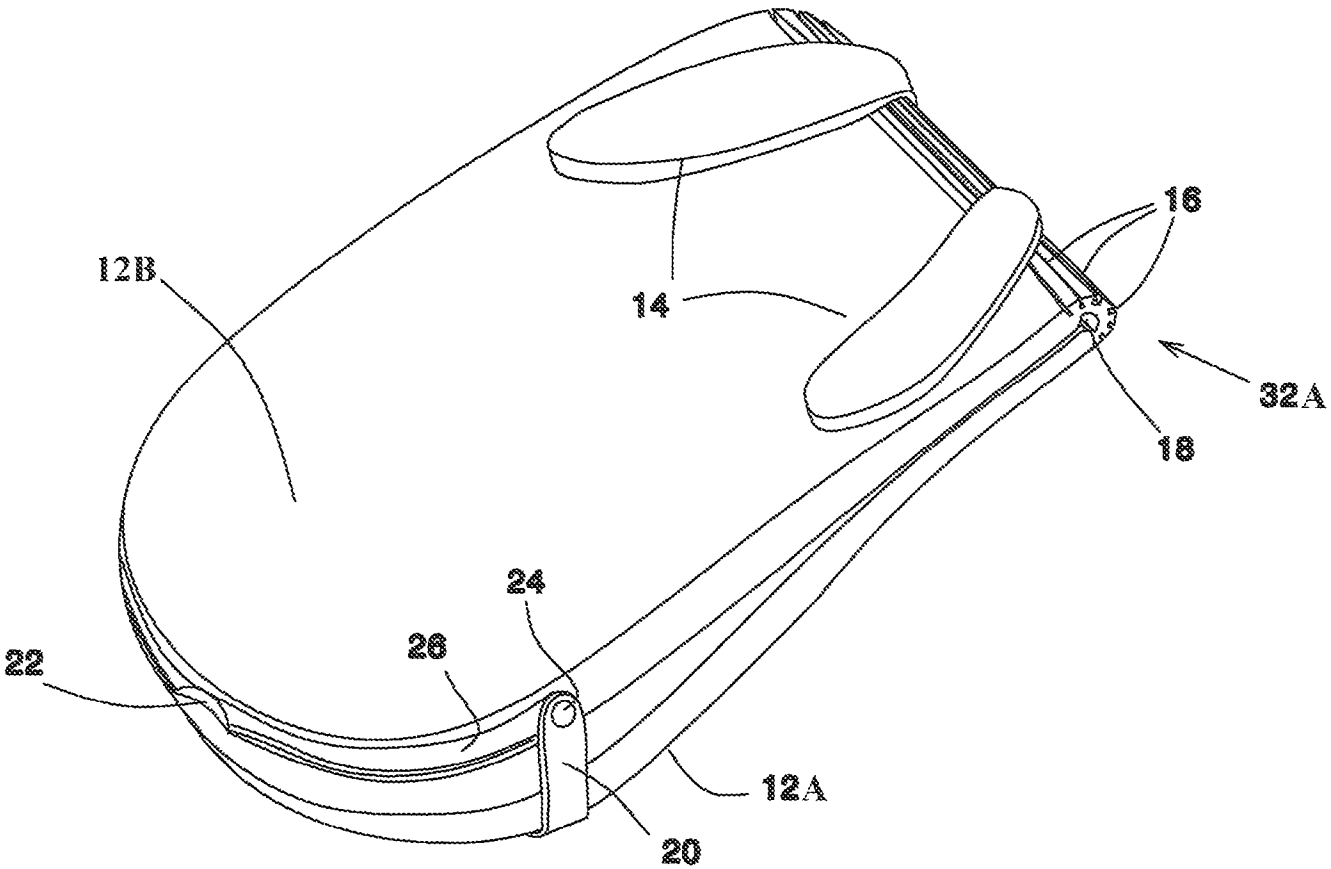
FIG. 2 depicts the foldable footwear of FIG. 1 at the folded state.

FIG. 2 depicts the foldable footwear 10 of FIG. 1 at the folded state, wherein the back portion 12B is shown on top of the front portion 12A.

Foldable structure 32A may include a foldable layer 42 (shown in FIG. 3), which is connected to both sole-portions 12A and 12B. A plurality of transverse parallel adjacent bands 16 extend from the foldable layer 42 towards the foot-side of footwear 10. Upon folding footwear 10, bands 16 are drawn away one from the other; upon deploying footwear 10, bands 16 approach one another.

Pivots 24 connect the stretchable strap 20 to sole-portions 12A or 12B.

Figure 3:
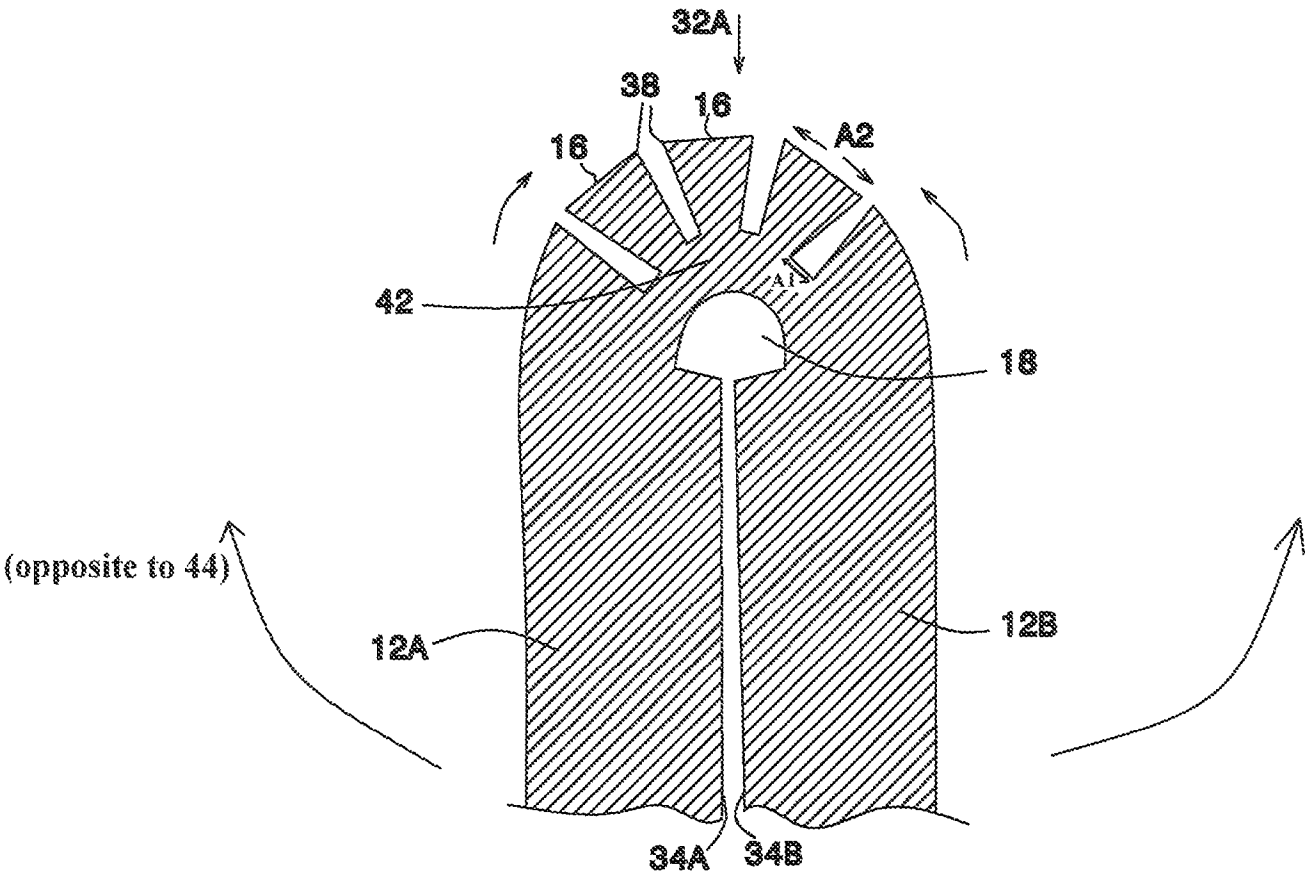
FIG. 3 is a side view of the foldable footwear of FIG. 1 at the folded state, focusing at the foldable structure.

FIG. 3 is a side view of the foldable footwear 10 of FIG. 1 at the folded state, focusing on the foldable structure 32A.

Each of the transverse bands 16 may widen along the extending direction, i.e., the width A2 at the end of band 16 is wider than the width A1 of band 16 touching the foldable layer 42.

Even at the folded state of FIG. 3, where bands 16 are drawn away one from the other, external edges 38 of adjacent bands 16 are disposed close or even touch one another.

A transverse depression (groove) 18 at the ground-side of foldable structure 32A prevents rejection forces between sole-portions 12A and 12B upon the folding.

In some embodiments, the flexible (foldable) layer 42 can assist in preventing the footwear 10 from folding in the direction opposing the single folding direction 44 by designing widening (from A1 to A2) such that each of the bands 16 has a narrower base touching the flexible layer 42 and a wider upper part A2 thereby providing mutual pressure between the adjacent bands 16 upon deployment of the footwear 10 and preventing the footwear from folding in the direction contrary to arrow 44.

Figure 4:
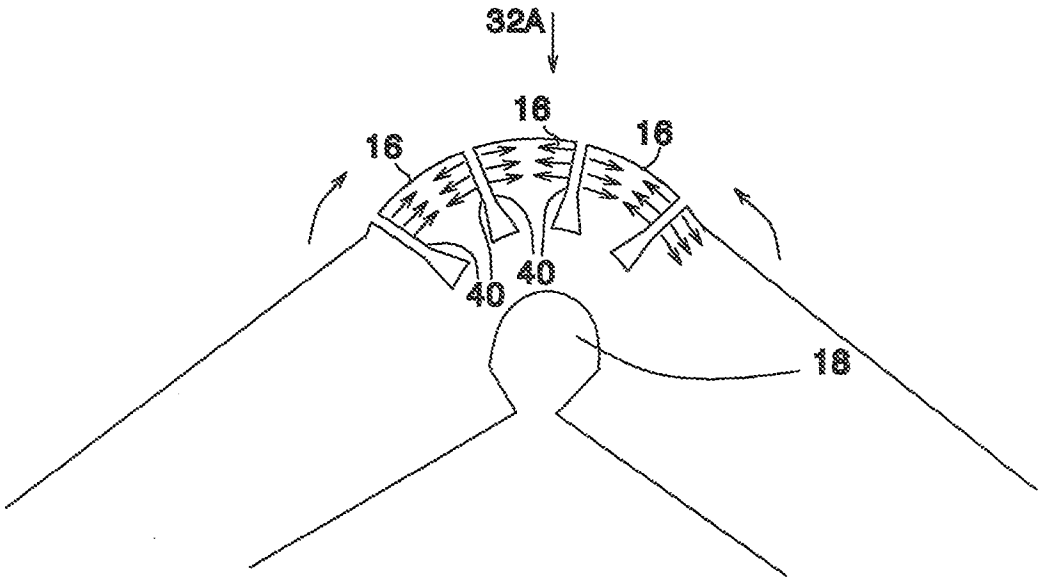
FIG. 4 is a side view of the foldable structure of the foldable footwear of FIG. 1 at an intermediate state between the folded state of FIG. 3 and the deployed state.

FIG. 4 is a side view of the foldable structure 32A of the foldable footwear 10 of FIG. 1 at an intermediate state between the folded state of FIG. 3 and the deployed state.

At such an intermediate state, not only external edges 38 of adjacent bands 16 may contact one another, but also side surfaces 40 of adjacent bands 16 when extending mutually pressed against each other apply a force on each other as shown in the arrows inside bands 16.

Figure 5:
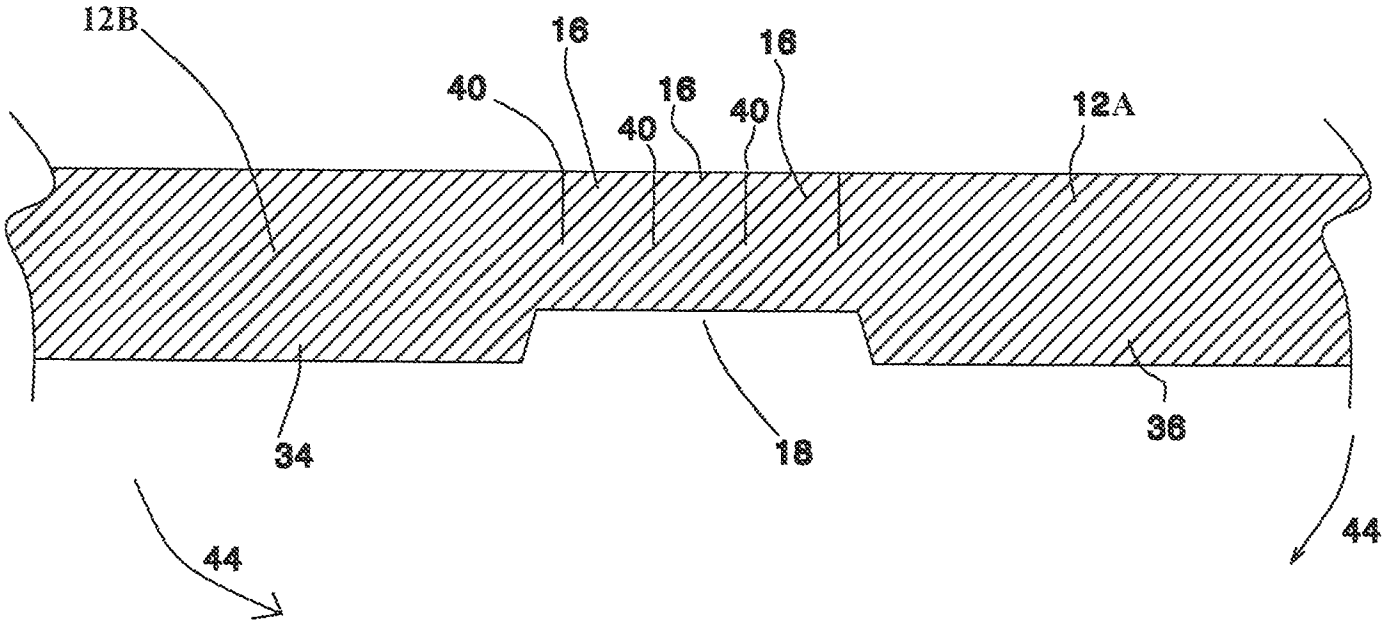
FIG. 5 is a side view of the foldable structure of the foldable footwear of FIG. 1 at the deployed state.

FIG. 5 is a side view of the foldable structure 32A of the foldable footwear 10 of FIG. 1 at the deployed state.

Upon full deployment of footwear 10, not only external surfaces 40 touch one another but also the entire surfaces 40 of adjacent bands 16 are pressed one on the other, disallowing further pressure.

This pressure between sides 40 of adjacent bands 16 prevents folding footwear 10 to the direction opposite to arrows 44.

Figure 6:
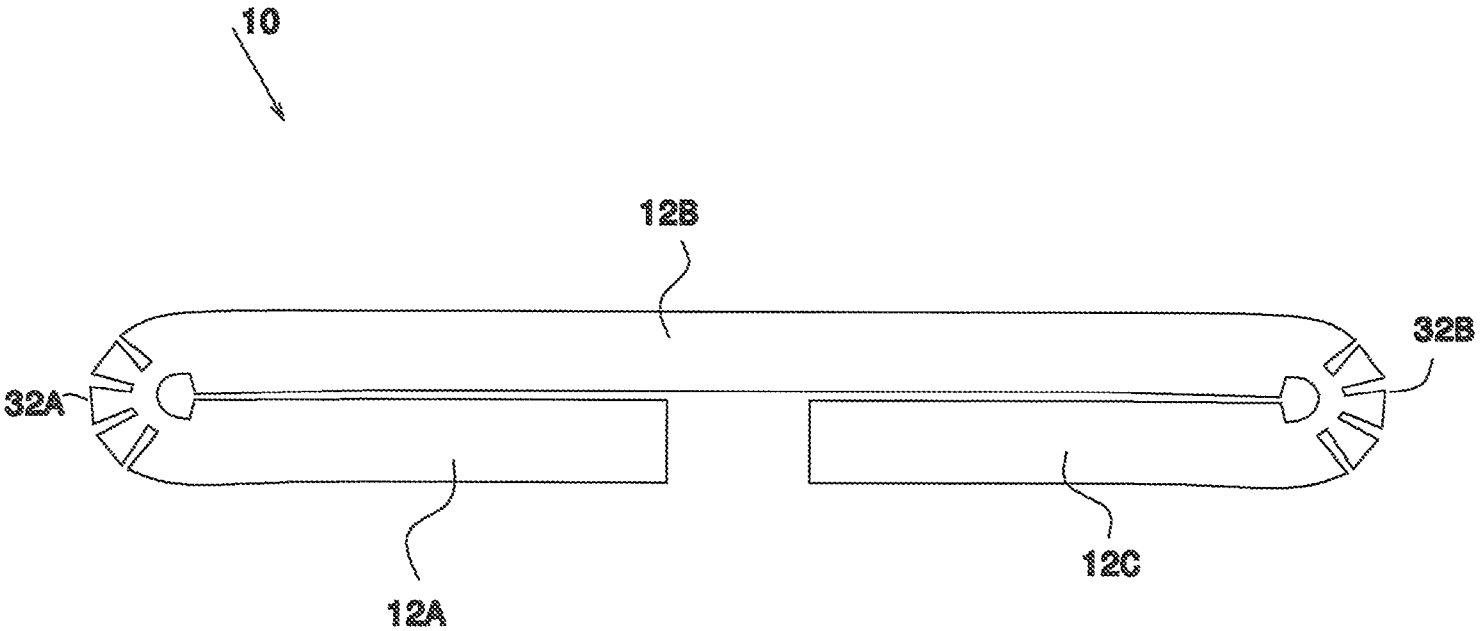
FIG. 6 is a side view of the foldable structure of a foldable footwear of FIG. 1 according to another embodiment.

FIG. 6 is a side view of the foldable structure 32A of a foldable footwear 10 according to another embodiment.

Footwear 10 may include more than one foldable structure 32A. According to the example of FIG. 6, footwear 10 may be folded to three pieces, as footwear 10 includes two consequent sole-portions pairs. The first sole-portions pair includes sole-portion 12A and sole-portion 12B, and the second sole-portions pair includes sole-portion 12B and sole-portion 12C.

According to some embodiments, the first sole-portions pair is foldable by foldable structure 32A, and the second sole-portions pair is foldable by foldable structure 32B.

The folding of both sole-portions pairs is in the same direction.

Figure 7:
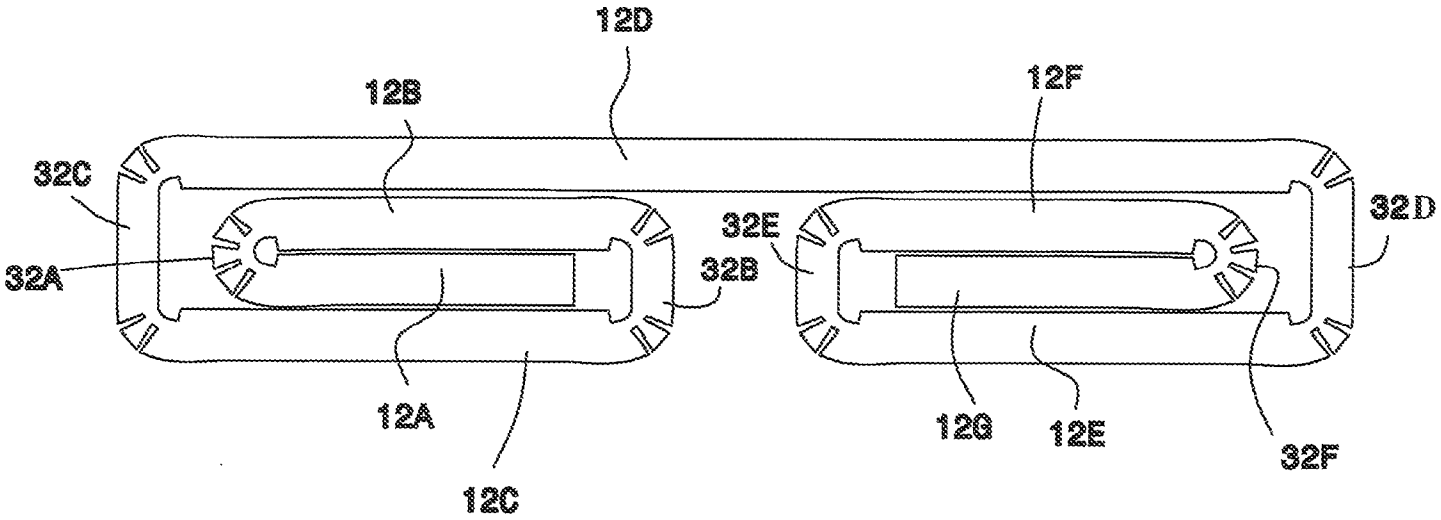
FIG. 7 is a side view of the foldable structure of a foldable footwear of FIG. 1 according to another embodiment.

FIG. 7 is a side view of the foldable structure of a foldable footwear 10 according to another embodiment.

According to the example of FIG. 7 footwear 10 may be folded to five pieces. Sole-portion 12A and sole-portion 12B are foldable by foldable structure 32A in between them; sole-portion 12B and sole-portion 12C are foldable by foldable structure 32C in between them; sole-portion 12C and sole-portion 12D are foldable by foldable structure 32C in between them; sole-portion 12D and sole-portion 12E are foldable by foldable structure 32D in between them; sole-portion 12E and sole-portion 12F are foldable by foldable structure 32E in between them; and sole-portion 12F and sole-portion 12G are foldable by foldable structure 32F in between them.

Figure 8:
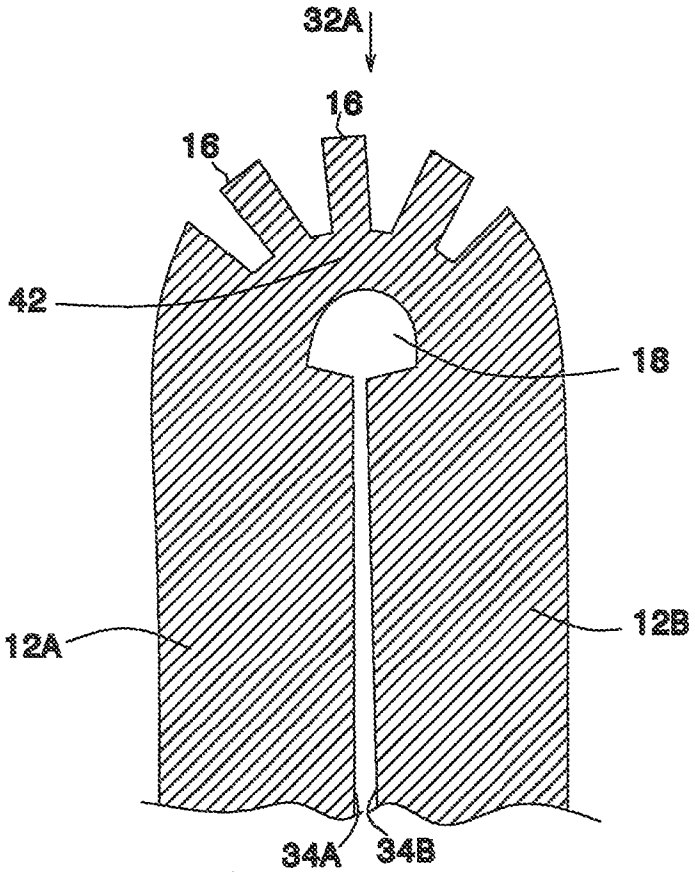
FIG. 8 is a side view of the foldable structure of a foldable footwear of FIG. 1 according to another embodiment.

FIG. 8 is a side view of the foldable footwear of FIG. 1 at the folded state, according to another embodiment.

According to this embodiment each of transverse bands 16 is parallel along the extending direction, thus the width of each band 16 is of a constant value, giving the bands 16 a substantially rectangular form.

The prevention from folding the flexible layer 42 to the direction opposing the single folding direction 44 is obtained by bands 16.

In some embodiments, the foldable sole 26 may comprise a series of sole-portions (32A, 32B, 32C, etc.), each for providing a single-directional folding to consequent sole-portion pairs (32A for 12A and 12B, 32B for 12B and 12C, etc.).

In the figures and/or description herein, the following reference numerals have been mentioned:

numeral 10 denotes a footwear or a shoe according to an embodiment of the present invention;

numerals 12A, 12B, 12C, 12D, 12E and 12F denote sole-portions of the footwear 10 numeral 14 denotes a stretchable strap, for attaching the user's foot to the footwear 10 numeral 16 denotes a band from a plurality of adjacent bands for preventing the footwear 10 from folding in the direction contrary to arrow 44 numeral 18 denotes a groove (depression), for allowing folding;

numeral 20 denotes a stretchable strap for retaining the folded state of the footwear 10;

numeral 22 denotes a depression for inserting a finger in order to manipulate the stretchable strap 20;

numeral 24 denotes a pivot for attaching the stretchable strap 20 to the footwear 10;

numeral 26 denotes a foldable sole;

numerals 32A, 32B, 32C, 32D, 32E denote foldable structures, each allowing folding a pair of sole-portions;

numerals 34A and 34B denote the sides of the sole 26 which touch the ground during wearing;

numeral 38 denotes an edge of a band 16;

numeral 40 denotes a side surface of a band 16;

numeral 42 denotes a foldable layer which is attached to both sole-portions 12A and 12B; preferably the foldable layer 42 and the soles-portions 12A and 12B are inherent elements, fabricated in a single casting; and numeral 44 denotes the single folding direction enabled by the footwear 10 of the invention.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

What is claimed is:

1. A foldable footwear comprising:

a. a sole fabricated using a single manufacturing casting, said sole having a ground side which is adapted to touch the ground when the footwear is worn and a foot side which is adapted to touch the user's foot when the footwear is worn, said sole comprising at least two portions, a front portion and a back portion;

b. at least one groove in the ground side of the sole, separating the front portion from the back portion and extending laterally from one side of the sole to the other side of the sole, said groove having a front portion edge and a back portion edge; and c. a connecting element attached to the front portion in at least one location and attached to the back portion in at least two locations, wherein said connecting element is configured to stretch when the footwear is worn thus helping to keep the sole unfolded;

wherein said footwear is adapted to be folded in one direction only where the ground side of the front portion is folded toward the ground side of the back portion such that the groove's front portion edge touches the groove's back portion edge; and wherein when the footwear is folded the foot side of the sole includes a plurality of notches, positioned above said groove, each of said notches having a substantially planar bottom surface, said notches forming a plurality of adjacent bands having side surfaces, and when the footwear is unfolded the side surfaces of the bands contact each other.

2. A foldable footwear comprising:

a. a sole fabricated using a single manufacturing casting, said sole having a ground side which is adapted to touch the ground when the footwear is worn and a foot side which is adapted to touch the user's foot when the footwear is worn, said sole comprising at least two portions, a front portion and a back portion;

b. at least one groove in the ground side of the sole, separating the front portion from the back portion and extending laterally from one side of the sole to the other side of the sole, said groove having a front portion edge and a back portion edge; and c. a connecting element attached to the front portion in at least one location and attached to the back portion in at least two locations, wherein said connecting element is configured to stretch when the footwear is worn thus helping to keep the sole unfolded; and d. a plurality of notches on the foot side of the sole, substantially positioned above said at least one groove, each of said notches having a substantially planar bottom surface, said notches forming a plurality of adjacent bands, wherein, when the footwear is folded, a width (A2) of each band on the foot side is larger than the width (A1) of the bottom surface of the adjacent notches;

wherein said footwear is adapted to be folded in one direction only where the ground side of the front portion is folded toward the ground side of the back portion such that the groove's front portion edge touches the groove's back portion edge.

3. The foldable footwear according to claim 1, wherein said groove comprises a channel that is arcuate in cross-section when the footwear is folded.

4. The foldable footwear according to claim 1, wherein the at least one groove has a height that is no more than 0.2 to 0.9 of the thickness of the sole.

5. The foldable footwear according to claim 1, wherein said at least one groove is positioned substantially in the middle of the sole.

6. The foldable footwear according to claim 1, wherein said footwear is a flip-flop sandal.

7. The foldable footwear according to claim 6, wherein the sole of said flip-flop sandal is made from a flexible material comprising rubber or polyurethane.

8. The foldable footwear according to claim 1, further comprising a strap, pivotally mounted on the sole, configured to retain the footwear in a folded state.

9. The foldable footwear according to claim 1, wherein said connecting element comprises stretchable straps adapted to attach the footwear to a user's foot.

10. The foldable footwear according to claim 2, wherein said groove comprises a channel that is arcuate in cross-section when the footwear is folded.

11. The foldable footwear according to claim 2, wherein the at least one groove has a height that is no more than 0.2 to 0.9 of the thickness of the sole.

12. The foldable footwear according to claim 2, wherein said at least one groove is positioned substantially in the middle of the sole.

13. The foldable footwear according to claim 2, wherein said footwear is a flip-flop sandal.

14. The foldable footwear according to claim 13, wherein the sole of said flip-flop sandal is made from a flexible material comprising rubber or polyurethane.

15. The foldable footwear according to claim 2, wherein said notches form a plurality of adjacent bands having side surfaces, and when the footwear is unfolded the side surfaces of the bands contact each other.

16. The foldable footwear according to claim 2, further comprising a strap, pivotally mounted on the sole, configured to retain the footwear in a folded state.

17. The foldable footwear according to claim 2, wherein said connecting element comprises stretchable straps adapted to attach the footwear to a user's foot.

* * * * *